US009728141B2

(12) United States Patent
Yang et al.

(10) Patent No.: US 9,728,141 B2
(45) Date of Patent: Aug. 8, 2017

(54) PROJECTION DISPLAY DEVICE AND DRIVING METHOD

(71) Applicant: DELTA ELECTRONICS, INC., Taoyuan Hsien (TW)

(72) Inventors: Chung-Yi Yang, Taoyuan Hsien (TW); Bor Wang, Taoyuan Hsien (TW); Cheng-Hsun Chang, Taoyuan Hsien (TW)

(73) Assignee: DELTA ELECTRONICS, INC. (TW)

( * ) Notice: Subject to any disclaimer, the term of this patent is extended or adjusted under 35 U.S.C. 154(b) by 321 days.

(21) Appl. No.: 14/190,576

(22) Filed: Feb. 26, 2014

(65) Prior Publication Data

US 2015/0070412 A1 Mar. 12, 2015

(30) Foreign Application Priority Data

Sep. 10, 2013 (TW) ..... 102132511 A

(51) Int. Cl.
*G09G 3/34* (2006.01)

(52) U.S. Cl.
CPC ..... *G09G 3/3406* (2013.01); *G09G 2310/061* (2013.01)

(58) Field of Classification Search
CPC ..... G09G 3/3406; G09G 2310/061; G09G 2320/0238
USPC ..... 345/102
See application file for complete search history.

(56) References Cited

U.S. PATENT DOCUMENTS

2005/0007389 A1* 1/2005 Kumamoto ..... G09G 3/3406 345/690
2005/0195148 A1* 9/2005 Iisaka ..... G09G 3/3614 345/98
2006/0092117 A1* 5/2006 Kubota ..... G09G 3/3648 345/94
2007/0126757 A1* 6/2007 Itoh ..... G09G 3/3233 345/690
2007/0229447 A1* 10/2007 Takahara ..... G09G 3/3406 345/102
2009/0237347 A1* 9/2009 Yamagishi ..... G09G 3/3406 345/102
2011/0043771 A1 2/2011 Hirao
2013/0135590 A1* 5/2013 Homma ..... G03B 21/2073 353/20

FOREIGN PATENT DOCUMENTS

CN 101998738 3/2011

* cited by examiner

*Primary Examiner* — Amr Awad
*Assistant Examiner* — Stephen Bray
(74) *Attorney, Agent, or Firm* — Hauptman Ham, LLP

(57) ABSTRACT

A projection display device is disclosed herein. The projection display device includes an image processing module and a light source driver. The image processing module is configured for receiving an image data and generating a display signal which includes an image period and a black state period. The light source driver is configured for generating a light driving signal to drive a projection light source, wherein the light driving signal includes a first segment and a second segment in the black state period, and the average amplitude of the light driving signal in the second segment is lower than the average amplitude of the light driving signal in the image period. A driving method is disclosed herein as well.

17 Claims, 6 Drawing Sheets

PROJECTION DISPLAY DEVICE AND DRIVING METHOD

RELATED APPLICATIONS

This application claims priority to Taiwan Application Serial Number 102132511, filed Sep. 10, 2013, which is herein incorporated by reference.

BACKGROUND

Field of Invention

The present invention relates to a projection device. More particularly, the present invention relates to a projection device and the driving method thereof using black frame insertion technology.

Description of Related Art

As the development of the display resolution, the requirement for the quality of display image becomes greater. There are many causes resulting in a blurred display image, for example, the slow response time of the pixel in the display, interpolation and elimination during image scaling, distortion from image compression/decompression, or visual tracing for high speed image.

Referring to FIG. 1, FIG. 1 is a schematic diagram of black frame insertion according to a prior art. In the prior art, one of the methods to improve the quality of a dynamic image is black frame insertion. Generally, black frame insertion is inserting a black frame data 102 into the image data 100 with a fixed period as shown in FIG. 1. Thus, the image data 100 has image periods Ta and black state periods Tb. If the luminance of the back light is fixed (e.g., light driving signal 120), the longer the black state period is, the lower the actual brightness of the image is. Furthermore, the display device does not output any image during the black state period. Therefore, the power consumption of the backlight during this period is wasted equivalently, and the dynamic contrast ratio is decreased at the same time.

Accordingly, the person skilled in this art is devoted to finding out the solution of the issue above and to improving the problem so far.

SUMMARY

In order to solve the problem above, this disclosure provides a projection display device. The projection display device includes an image processing module and a light source driver. The image processing module is configured for receiving an image data and generating a display signal which includes an image period and a black state period. The light source driver is configured for generating a light driving signal to drive a projection light source, wherein the light driving signal has a first segment and a second segment in the black state period, and an average amplitude of the light driving signal in the second segment is lower than the average amplitude of the light driving signal in the image period.

According to one embodiment of this disclosure, the average amplitude of the light driving signal in the first segment is larger than the average amplitude of the light driving signal in the second segment and the average amplitude of the light driving signal in the image period.

According to one embodiment of this disclosure, a current level of the light driving signal in the first segment is higher than the current level of the light driving signal in the second segment during the positive half period of the light driving signal.

According to one embodiment of this disclosure, a current level of the light driving signal in the second segment is higher than the current level of the light driving signal in the first segment during the negative half period of the light driving signal.

According to one embodiment of this disclosure, the average amplitude of the light driving signal in the second segment is equal to about 30% of the average amplitude of the light driving in the image period.

According to one embodiment of this disclosure, the average amplitude of the light driving signal in the first segment and the second segment is equal to zero.

Another aspect of this disclosure is to provide a projection display device. The projection display device includes an image processing unit, a display unit, a micro controller, a light source driver and a projection light source. The display unit is electrically coupled to the image processing unit and configured for generating an image signal which includes an image period and a black state period. The micro controller is electrically coupled to the image processing unit. The light source driver is electrically coupled to the micro controller and the display unit. The projection light source is electrically coupled to the light source driver and is configured for projecting the image signal to a projection screen. The light source driver is configured for generating a light driving signal to drive the projection light source, wherein the light driving signal has a first segment and a second segment in the black state period, and the average amplitude of the light driving signal in the second segment is lower than the average amplitude of the light driving signal in the image period.

Further another aspect of this disclosure is to provide a driving method for driving a projection display device to display an image data. The driving method includes the steps of: receiving and adjusting the image data to make the image data include an image period and a black state period; and adjusting a light driving signal of a projection light source of the projection display device to make the light driving signal include a first segment and a second segment in the black state period, and an average amplitude of the light driving signal in the second segment is lower than the average amplitude of the light driving signal in the image period.

According to one embodiment of this disclosure, in the step of adjusting a light source driving signal of a projection light source further includes following step: the average amplitude of the light driving signal in the first segment is configured to be larger than the average amplitude of the light driving signal in the second segment and the average amplitude of the light driving signal in the image period.

According to one embodiment of this disclosure, during the positive half period of the light driving signal, a current level of the light driving signal in the first segment is configured to be higher than the current level of the light driving signal in the second segment.

According to one embodiment of this disclosure, during the negative half period of the light driving signal, a current level of the light driving signal in the second segment is configured to be higher than the current level of the light driving signal in the first segment.

According to one embodiment of this disclosure, the average amplitude of the light driving signal in the second segment is configured to equal to about 30% of the average amplitude of the light driving signal in the image period.

According to one embodiment of this disclosure, the step of adjusting a light source driving signal of a projection light source of the projection display device, the average amplitude of the light driving signal in the first segment and the second segment is configured to be equal to zero.

In summary, comparing with the prior art, the technology of this disclosure possesses significant advantages and benefits. According to the solution above, the technology is significantly improved and the solution may be widely utilized in this industry. The projection display device and the driving method thereof disclosed herein improve the quality of image and reduce the power consumption meanwhile.

These and other features, aspects, and advantages of the present disclosure will become better understood with reference to the following description, the accompanying drawings and appended claims.

It is to be understood that both the foregoing general description and the following detailed description are by examples, and are intended to provide further explanation of the disclosure as claimed.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

DESCRIPTION OF THE EMBODIMENTS

Figure 1:
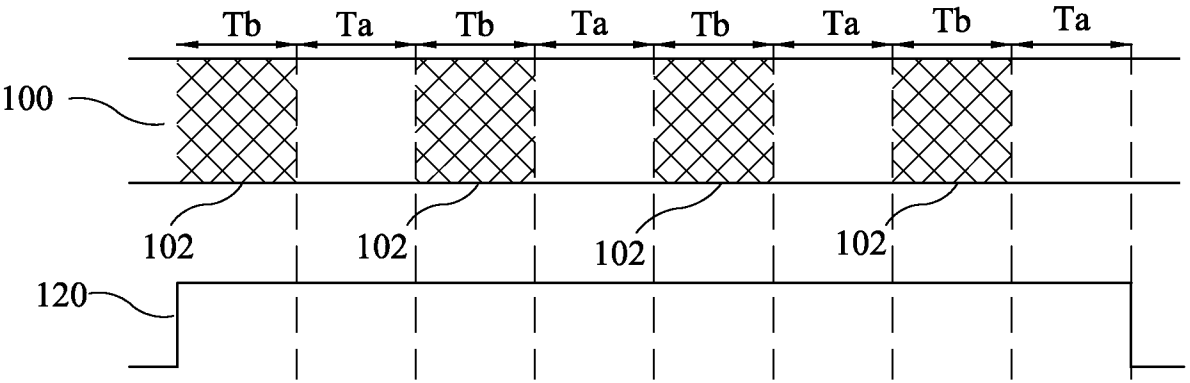
FIG. 1(PRIOR ART)
FIG. 1 is a schematic diagram of black frame insertion according to the prior art.

Reference will now be made in detail to the present embodiments of the disclosure, examples of which are illustrated in the accompanying drawings. Wherever possible, the same reference numbers are used in the drawings and the description to refer to the same or like parts.

The terms "first", "second" . . . etc. used in the specification do not imply a specific sequence or order and not limit this disclosure. The terms are utilized to distinguish components or operations with same technical description.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about", "substantially" or "approximately" can be inferred if not expressly stated.

In this document, the term "coupled" may also be termed as "electrically coupled", and the term "connected" may be termed as "electrically connected". "Coupled" and "connected" may also be used to indicate that two or more elements cooperate or interact with each other.

Figure 2:
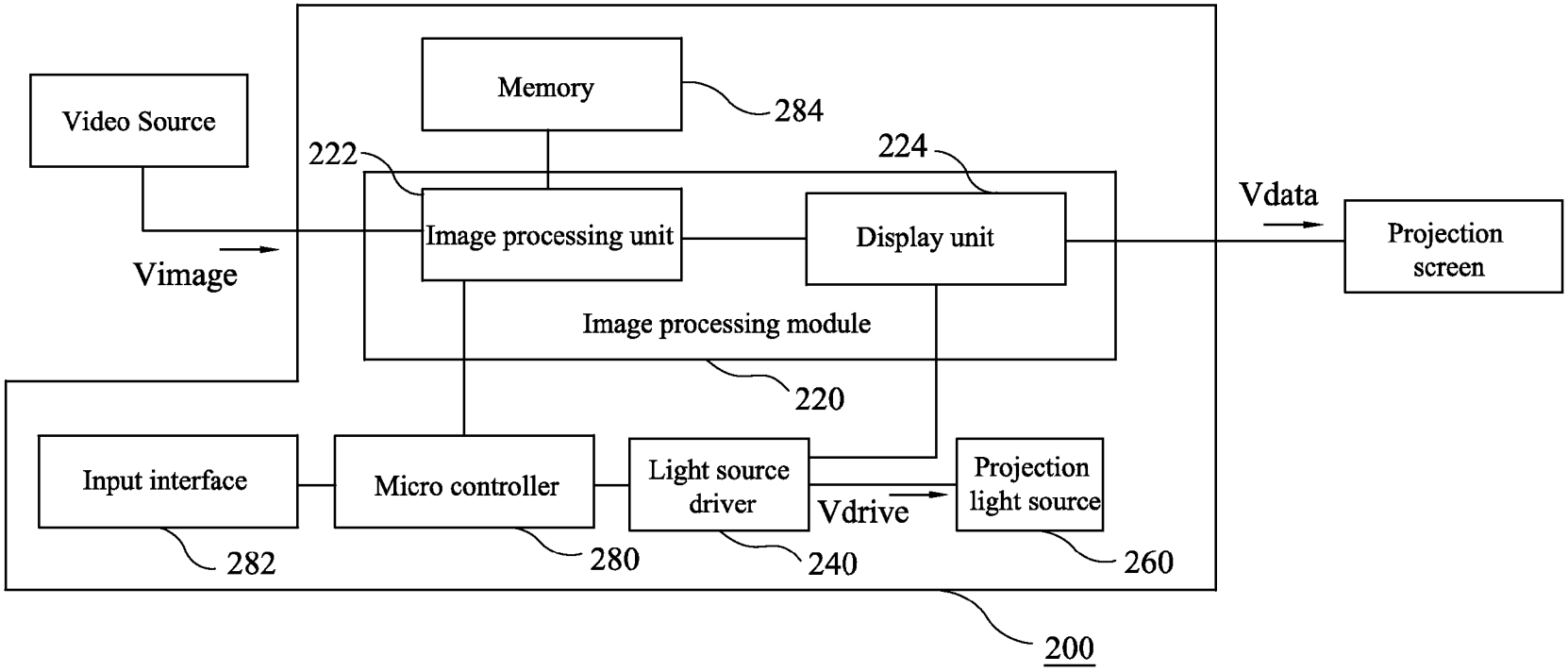
FIG. 2 is a schematic diagram of a projection display device according to one embodiment of this disclosure.
Figure 3:
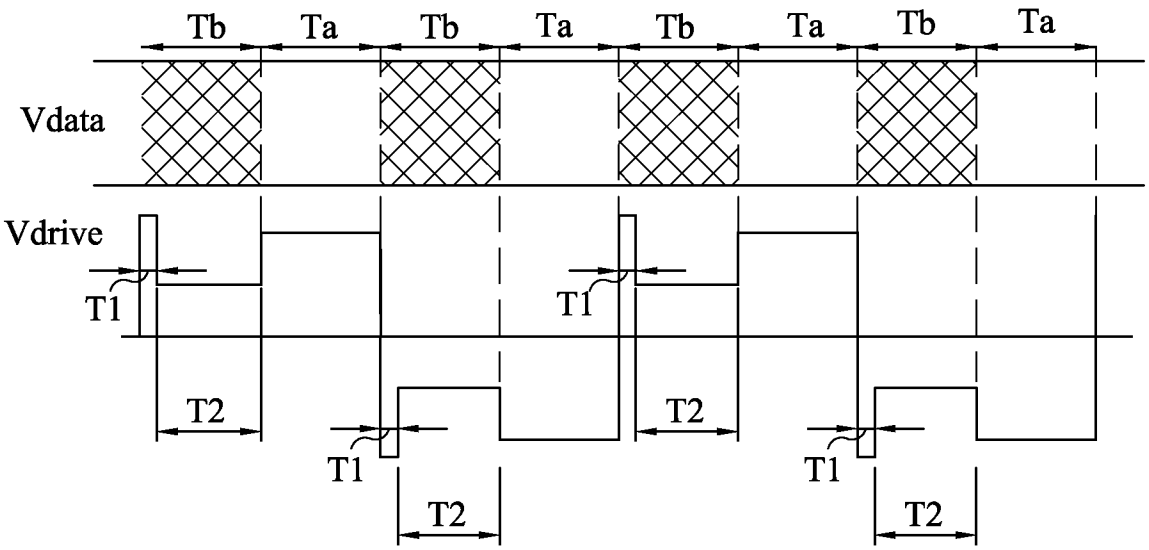
FIG. 3 is a waveform graph of the light driving signal according to one embodiment of this disclosure.

Referring FIG. 2, FIG. 2 is a schematic diagram of a projection display device according to one embodiment of this disclosure. As shown in FIG. 2, the projection display device 200 includes an image processing module 220 and a light source driver 240. The image processing module 220 is configured for receiving an image data Vimage and generating a display signal Vdata. The display signal Vdata includes an image period Ta and a black state period Tb. In other words, the image data Vimage is processed by the image processing module 220. Accordingly, the black frame insertion is utilized in the image data Vimage. Thus, the waveform of the display signal Vdata includes the image period Ta and the black state period Tb. The light source driver 240 is configured for generating a light driving signal Vdrive to drive a projection light source 260 of the projection display device 200. The light driving signal Vdrive has a first segment and a second segment in the black state period Tb, and an average amplitude of the light driving signal Vdrive in the second segment is lower than the average amplitude of the light driving signal Vdrive in the image period Ta (as shown in FIG. 3 later). Briefly, during the black state period Tb of the display signal Vdata, the power consumption of the projection display device 200 is reduced by lowering or closing the average amplitude of the light driving signal Vdrive. Meanwhile, the dynamic contrast ratio is increased by reducing the luminance of back light during the black state period Tb.

It should be noted that the light driving signal Vdrive may be a voltage signal or a current signal and may also indicate the driving current passed through the projection light source 260. However, this disclosure is not limited to the configuration above, and the person skilled in the art may modify the configuration as required.

On the other hand, as shown in FIG. 2, the image processing module 220 may further include an image processing unit 222 and a display unit 224. The image processing unit 222 is configured to process the image data Vimage and perform the operations of black frame insertion. The display unit 224 is electrically coupled to the image processing unit 222. The display unit 224 is configured for generating and displaying the display signal Vdata. The display unit 224 may be a panel with light valve or a corresponding LCD panel, etc. Furthermore, the projection display device 200 may further include a micro controller 280 and a memory 284. The micro controller 280 is configured for receiving a control signal from an input interface 282, and performing dimming operations. The memory 284 is electrically coupled to the image processing unit 222. The memory 284 is configured for providing a buffer space for the image processing unit 222 during executing operations. For example, the input interface 282 may be a keyboard or an infrared remote controller, etc. In the view of construction, the micro controller 280 is electrically coupled to the input interface 282. The light source driver 240 is electrically coupled to the micro controller 280. The display unit 224 and the projection light source 260 are electrically coupled to the light source driver 240. With such a configuration, the corresponding operations of the dimming control are accomplished and the image (e.g. the display signal Vdata) is projected to a projection screen by the display unit 224.

Different embodiments of this disclosure to accomplish the adjustment of the light driving signal Vdrive will be described below. Referring to FIG. 3, FIG. 3 is a waveform graph of the light driving signal according to one embodiment of present disclosure. As shown in FIG. 3, in the black state period Tb of the display signal Vdata, the light driving signal Vdrive has a first segment T1 and a second segment T2, and the average amplitude of the light driving signal Vdrive in the second segment T2 is lower than the average amplitude of the light driving signal Vdrive in the image period Ta. In this embodiment, the signal average amplitude of the light driving signal Vdrive in the first segment T1 is larger than the average amplitude of the light driving signal Vdrive in the second segment T2 and the average amplitude of the light driving signal Vdrive in the image period Ta. For example, the projection light source 260 of the projection display device 200 may be an Ultra-high-performance (UHP) lamp. The driving characteristic of the UHP lamp is that the UHP lamp is lighten by tip discharging with a high voltage, when the driving current (i.e. the light driving signal Vdrive) passes through the electrodes in the lamp.

In operation, when the driving current passes through the electrodes, the average amplitude of the light driving signal Vdrive in the first segment T1 is increased to enhance the luminance instantly and reduce the flicker phenomenon owing to phase changing of the driving current. Therefore, the flexibility of the electrode design for the UHP lamp is improved and the lifetime of the lamp is increased. During the second segment T2, the average amplitude of the light driving signal Vdrive is reduced to save the un-necessary power consumption. For example, as shown in FIG. 3, during the positive half period of the light driving signal Vdrive, the current level of the light driving signal Vdrive in the first segment T1 is higher than the current level of the light driving signal Vdrive in the second segment T2. Alternatively, during the negative half period of the light driving signal Vdrive, the current level of the light driving signal Vdrive in the second segment T2 is higher than the current level of the light driving signal Vdrive in the first segment T1. In practice, when the projection light source 260 is the UHP lamp, the UHP lamp cannot be switched off and then on in a short period. Thus, the average amplitude of the light driving signal Vdrive in the second segment T2 is configured to be equal to about 30% of the average amplitude of the light driving signal Vdrive in the image period Ta. However, the invention is not limited to the configuration above, and the person skilled in the art may modify the configuration as required.

Figure 4A:
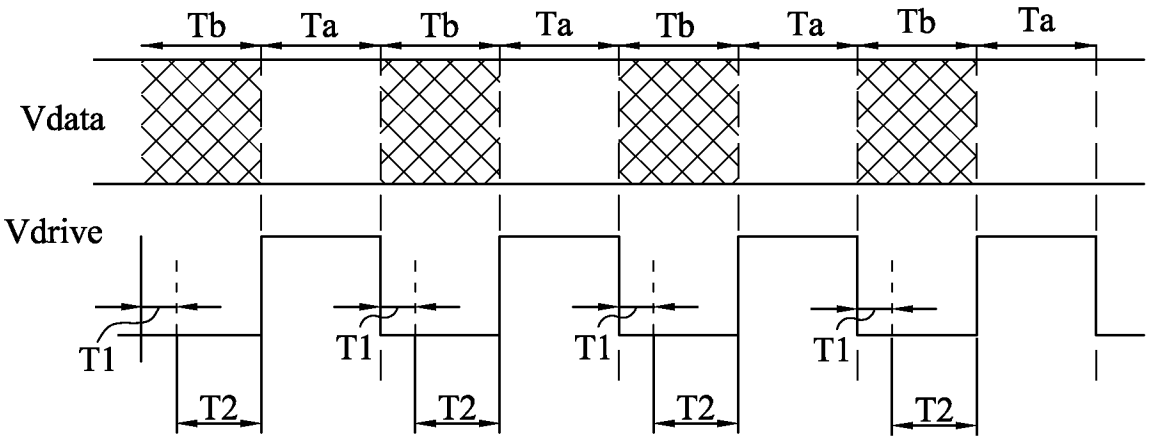
FIG. 4A is a waveform graph of the light driving signal according to another embodiment of this disclosure.

Referring to FIG. 4A, FIG. 4A is a waveform graph of the light driving signal according to another embodiment of this disclosure. As shown in FIG. 4A, in this embodiment, the projection light source 260 is a solid state luminance (SSI) or a LED lamp. Due to the characteristic of the solid state luminance or the LED lamp can be switched on or off in a short period, the average amplitude of the light driving signal Vdrive in the first segment T1 and the second segment T2 is configured to be equal to zero. Thus, the power consumption in the black state period Tb is saved thoroughly.

Figure 4B:
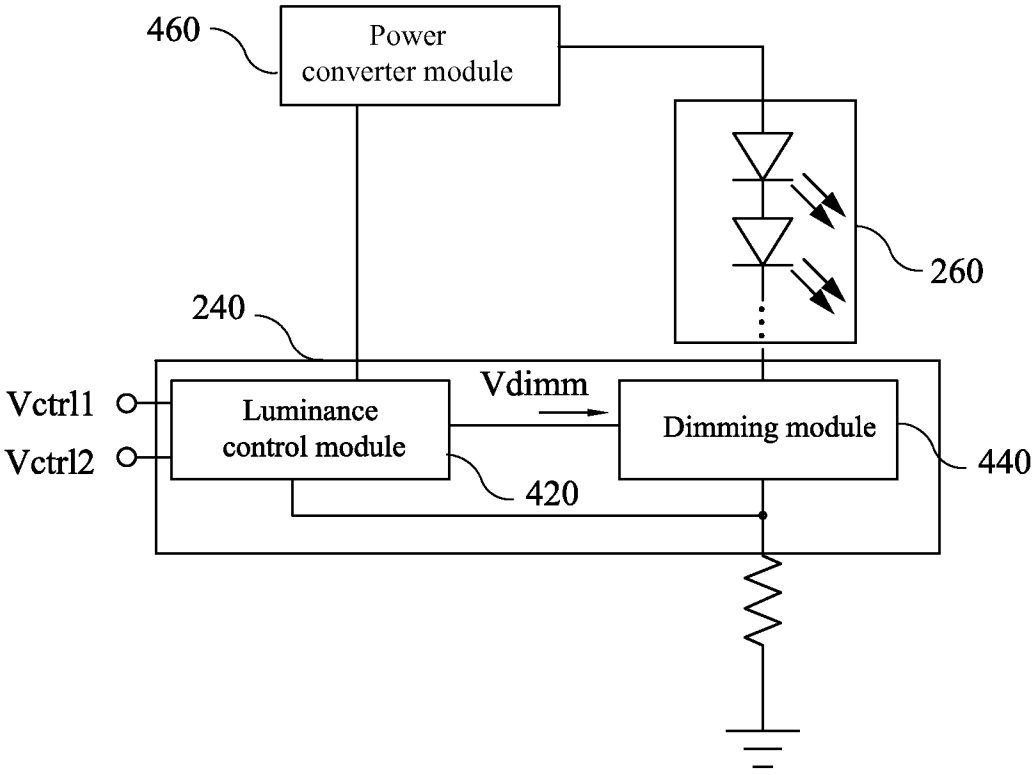
FIG. 4B is a schematic diagram of a light source driver as shown in FIG. 2 according to one embodiment of this disclosure.

Referring to FIG. 4B, FIG. 4B is a schematic diagram of a light source driver as shown in FIG. 2 according to one embodiment of this disclosure. As shown in FIG. 4B, in the embodiment above, the light source driver 240 may be utilized in the embodiment of FIG. 4A and further includes a luminance control module 420, a dimming module 440 and a power converter module 460. The luminance control module 420 is configured to generate a dimming signal Vdimm according to a current control signal Vctrl1 and a dimming control signal Vctrl2. The dimming module 440 is configured to adjust the luminance of the projection light source 260 according to the dimming signal Vdimm. The power converter module 460 is configured to convert and transmit a driving voltage. For example, the luminance control module 420 may be a PWM control module or a constant current control circuit, which is feedback controlled by the sensing resistor connected to the dimming module 440. The dimming module 440 may be a power switch or an array of adjustable current-limiting switches. Accordingly, the average amplitude of the light driving signal Vdrive is adjusted by the current control signal Vctrl1 and the corresponding dimming control is thus accomplished by the dimming control signal Vctrl2. Furthermore, referring to FIG. 2, in this embodiment, the projection display device 200 further utilizes the micro controller 280 to receive setting commands for the current control signal Vctrl1 and the dimming control signal Vctrl2 from the input interface 282.

Figure 5:
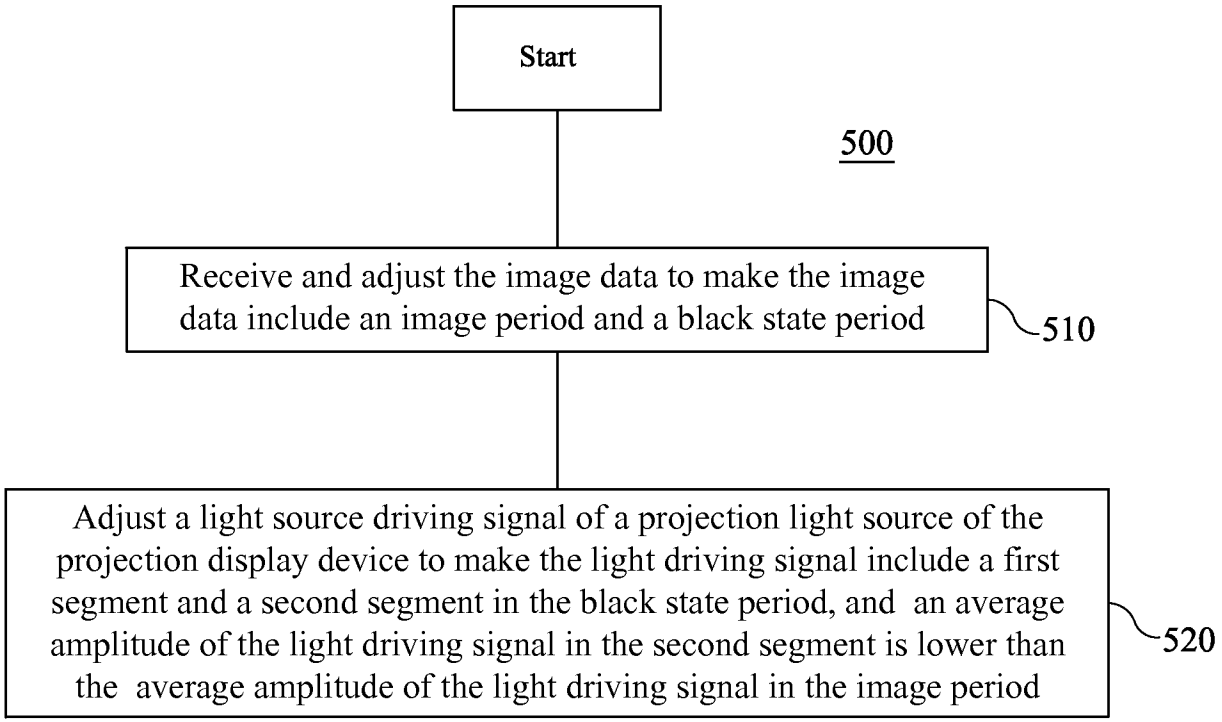
FIG. 5 is a flow chart of a driving method according to one embodiment of this disclosure.

Another aspect of this disclosure provides a driving method for driving a projection display device to display an image data. Referring to FIG. 5, FIG. 5 is a flow chart of a driving method according to one embodiment of this disclosure. As shown in FIG. 5, the driving method 500 includes the step 510 and step 520. In step 510, the image data is received and adjusted to have an image period Ta and a black state period Tb. For example, the image data is received from an audio/video-transmitting interface and the operations of black frame insertion are performed on the image data to make the image data include the image period Ta and the black state period Tb. In step 520, the light source driving signal Vdrive of a projection light source of the projection display device is adjusted, so as to make the light driving signal Vdrive have a first segment T1 and a second segment T2 in the black state period Tb, and the average amplitude of the light driving signal Vdrive in the second segment T2 is lower than the average amplitude of the light driving signal Vdrive in the image period Ta.

In step 520, the average amplitude of the light driving signal Vdrive in the first segment T1 is further configured to be larger than the average amplitude of the light driving signal Vdrive in the second segment T2 and the average amplitude of the light driving signal Vdrive in the image period Ta. For example, as shown in FIG. 3, when the projection light source 260 of the projection display device 200 is an UHP lamp, according to the characteristic of the UHP lamp, the average amplitude of the light driving signal Vdrive may be increased during the first segment T1, while the average amplitude of the light driving signal Vdrive may be reduced during the second segment T2 to save the un-necessary power consumption. For example, during the positive half period of the light driving signal Vdrive, the current level of the light driving signal Vdrive in the first segment T1 is higher than the current level of the light driving signal Vdrive in the second segment T2. Alternatively, during the negative half period of the light driving signal Vdrive, the current level of the light driving signal Vdrive in the second segment T2 is higher than the current level of the light driving signal Vdrive in the first segment T1. In this embodiment, the average amplitude of the light driving signal Vdrive in the second segment T2 may be configured to be equal to about 30% of the average amplitude of the light driving signal Vdrive in the image period Ta.

On the other hand, in step 520, the average amplitude of the light driving signal Vdrive in the first segment T1 and the second segment T2 may be further configured to equal to zero, so as to reduce the power consumption in the black state period Tb. For example, as shown in FIG. 4A, when the projection light source 260 of the projection display device 200 is a solid state luminance or a LED lamp, the light driving signal Vdrive may be shut down in the black state period Tb. Thus, the power saving and the dynamic contrast ration are further improved.

In summary, the projection display device and the driving method thereof of this disclosure are readily understood from various embodiments above. The power consumption of the projection display device is reduced by lowering or shutting down the average amplitude of the light driving signal. Meanwhile, the dynamic contrast ratio is also improved by reducing the luminance of back light during the black state period.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A projection display device, comprising:

an image processing module configured for receiving an image data and generating a display signal, the display signal comprising an image period and a black state period; and a light source driver configured for generating a light driving signal to drive a projection light source, wherein the projection light source is an ultra-high-performance (UHP) lamp, the light driving signal comprises a first segment and a second segment in the black state period, and an average amplitude of the light driving signal in the second segment is lower than the average amplitude of the light driving signal in the image period, and the amplitude of the light driving signal is constant in the image period, wherein the average amplitude of the light driving signal in the first segment is larger than the average amplitude of the light driving signal in the second segment and the average amplitude of the light driving signal in the image period.

2. The projection display device of claim 1, wherein a current level of the light driving signal in the first segment is higher than the current level of the light driving signal in the second segment during a positive half period of the light driving signal.

3. The projection display device of claim 1, wherein a current level of the light driving signal in the second segment is higher than the current level of the light driving signal in the first segment during an negative half period of the light driving signal.

4. The projection display device of claim 1, wherein the average amplitude of the light driving signal in the second segment is equal to about 30% of the signal average amplitude of the light driving signal in the image period.

5. The projection display device of claim 2, wherein the average amplitude of the light driving signal in the second segment is equal to about 30% of the signal average amplitude of the light driving signal in the image period.

6. The projection display device of claim 3, wherein the average amplitude of the light driving signal in the second segment is equal to about 30% of the signal average amplitude of the light driving signal in the image period.

7. The projection display device of claim 1, wherein the average amplitude of the light driving signal in the first segment and the second segment is equal to zero.

8. The projection display device of claim 7, wherein the light source driver further comprises:

a luminance control module configured for generating a dimming signal according to a current control signal and a dimming control signal; and a dimming module configured for adjusting the luminance of the projection light source according to the dimming signal.

9. The projection display device of claim 8, wherein the projection display device further comprises a micro controller configured for receiving a setting command for the current control signal and the dimming signal from an input interface.

10. A projection display device, comprising:

an image processing unit;

a display unit electrically coupled to the image processing unit and configured for generating an image signal, the image signal comprising an image period and a black state period;

a micro controller electrically coupled to the image processing unit;

a light source driver electrically coupled to the micro controller and the display unit; and a projection light source electrically coupled to the light source driver and configured for projecting the image signal to a projection screen, wherein the projection light source is an ultra-high-performance (UHP) lamp, the light source driver is configured for generating a light driving signal to drive the projection light source, wherein the light driving signal comprises a first segment and a second segment in the black state period, and a signal average amplitude of the light driving signal in the second segment is lower than the signal average amplitude of the light driving signal in the image period, and the amplitude of the light driving signal is constant in the image period, wherein the average amplitude of the light driving signal in the first segment is larger than the average amplitude of the light driving signal in the second segment and the average amplitude of the light driving signal in the image period.

11. A driving method for driving a projection display device to display an image data, the driving method comprising:

receiving and adjusting the image data to make the image data comprise an image period and a black state period; and adjusting a light driving signal of a projection light source of the projection display device to make the light driving signal comprise a first segment and a second segment in the black state period, and an average amplitude of the light driving signal in the second segment is lower than the average amplitude of the light driving signal in the image period, and the amplitude of the light driving signal is constant in the image period, wherein the projection light source is an ultra-high-performance (UHP) lamp, and the step of adjusting the light source driving signal of the projection light source further comprises:

configuring the average amplitude of the light driving signal in the first segment to be larger than the average amplitude of the light driving signal in the second segment and the average amplitude of the light driving signal in the image period.

12. The driving method of claim 11, wherein a current level of the light driving signal in the first segment is configured to be higher than the current level of the light driving signal in the second segment during a positive half period of the light driving signal.

13. The driving method of claim 11, wherein a current level of the light driving signal in the second segment is configured to be higher than the current level of the light driving signal in the first segment during the negative half period of the light driving signal.

14. The driving method of claim 11, wherein the average amplitude of the light driving signal in the second segment is configured to be equal to about 30% of the average amplitude of the light driving signal in the image period.

15. The driving method of claim 12, wherein the average amplitude of the light driving signal in the second segment is configured to be equal to about 30% of the average amplitude of the light driving signal in the image period.

16. The driving method of claim 13, wherein the average amplitude of the light driving signal in the second segment is configured to be equal to about 30% of the average amplitude of the light driving signal in the image period.

17. The driving method of claim 11, wherein the step of adjusting the light source driving signal of the projection light source of the projection display device further includes:

configuring the average amplitude of the light driving signal in the first segment and the second segment to zero.

* * * * *